United States Patent [19]

Marshall et al.

[11] 4,427,124

[45] * Jan. 24, 1984

[54] CHILD-RESISTANT CONTAINER

[75] Inventors: Francis G. Marshall, Meriden; Edward F. Klimeck, Waterbury, both of Conn.

[73] Assignee: Eyelet Specialty Co., Inc., Wallingford, Conn.

[ * ] Notice: The portion of the term of this patent subsequent to Jan. 24, 1995 has been disclaimed.

[21] Appl. No.: 804,592

[22] Filed: Jun. 8, 1977

Related U.S. Application Data

[63] Continuation-in-part of Ser. No. 704,690, Jul. 12, 1976, Pat. No. 4,069,942.

[51] Int. Cl.[3] ..... B65D 55/02

[52] U.S. Cl. ..... 215/216; 215/209

[58] Field of Search ..... 215/216, 209

[56] References Cited

U.S. PATENT DOCUMENTS 3,917,097 11/1975 Uhlig ..... 215/216

4,036,385 7/1977 Morris ..... 215/209

*Primary Examiner*—George T. Hall

*Attorney, Agent, or Firm*—Hopgood, Calimafde, Kalil, Blaustein & Judlowe

[57] ABSTRACT

The invention contemplates an essentially two-piece container, comprising a container-body member and a removable screw-cap closure member incorporating a child-resistant safety-locking feature in addition to providing threaded closure and sealing of the container member. The body member has ratchet-tooth formations integrally formed therewith, said formations coacting with ratchet-tooth formations on the inner surface of the closure member, when the closure member is threaded to the container member. The body-member tooth formations are covered by the closure-member skirt when in ratchet-locked position, but the body-member tooth formations are integral with a local resiliently compliant region of the body member whereby the ratchet-locked engagement may be released upon correctly localized inward squeezing of the compliant region.

5 Claims, 13 Drawing Figures

CHILD-RESISTANT CONTAINER

This application is a continuation-in-part of our copending application Ser. No. 704,690, filed July 12, 1976, now U.S. Pat. No. 4,069,942.

This invention relates to a container for pills or other materials which are considered hazardous, particularly to children, and more particularly to such containers having child-safety features.

It is an object of the invention to provide an improved container of the character indicated.

Another object is to provide improved child-safety mechanism for such a container.

A further object is to meet the above objects with essentially a two-piece construction, namely, a container-body member and a closure member having removable threaded engagement and incorporating child-safety mechanism to retain the secured relation of the threaded engagement.

A specific object is to achieve the above objects with a construction which avoids outwardly projecting tabs or other tamper-inviting formations.

Another specific object is to achieve the above objects with a construction lending itself to formation in the course of making a blow-molded plastic container.

A general object is to meet the above objects with structure of inherent simplicity, low fabrication cost, of fool-proof operation.

Other objects and various further features of novelty and invention will be pointed out or will occur to those skilled in the art from a reading of the following specification in conjunction with the accompanying drawings. In said drawings, which show, for illustrative purposes only, preferred forms of the invention;

Figure 10:
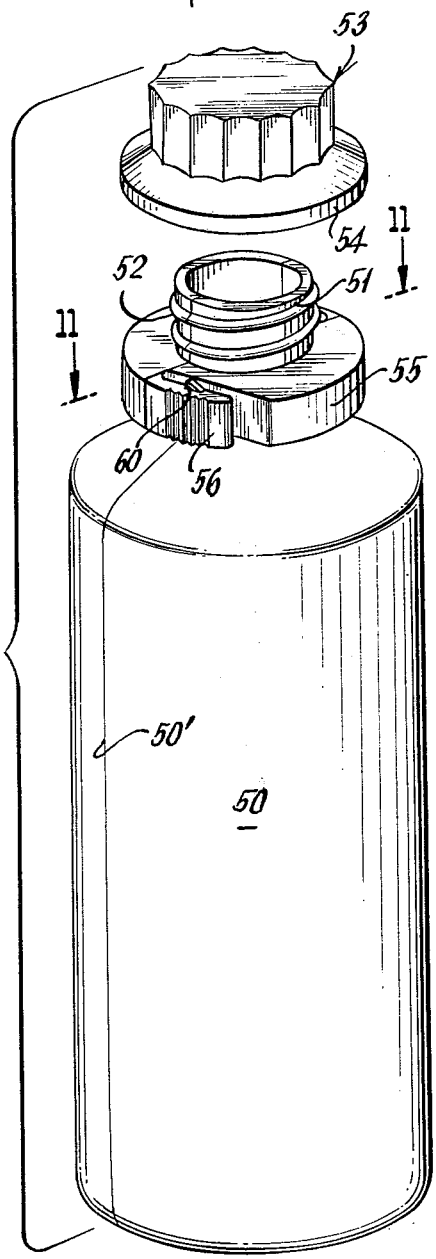
Figure 11:
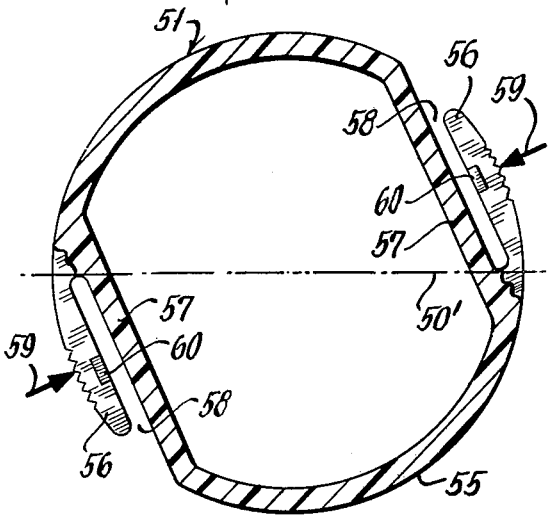
Figure 12:
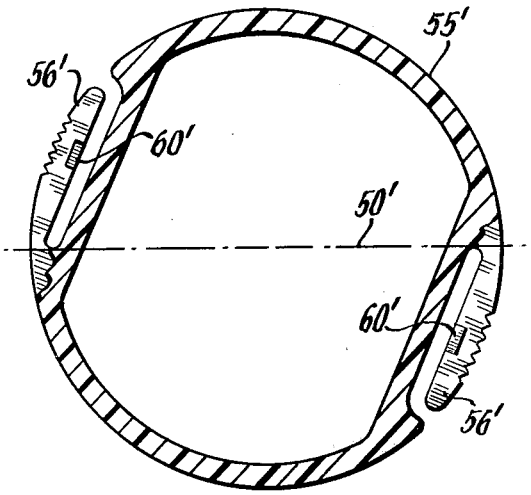
Figure 13:
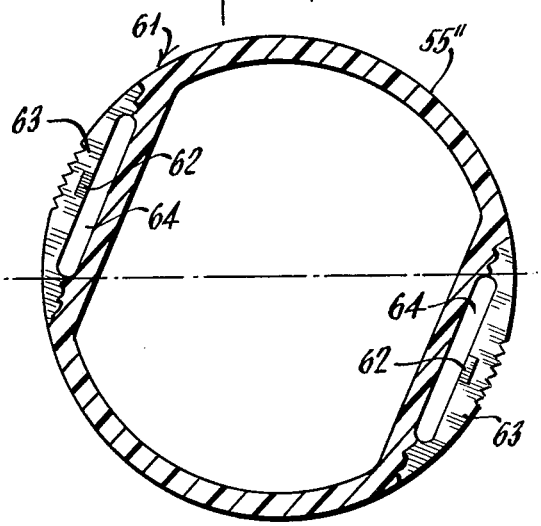

FIG. 10 is an exploded view in perspective, to show a modification, involving application of the invention to a blow-molded plastic container; and FIGS. 11, 12 and 13 are enlarged sectional views, taken at the plane 11—11 of FIG. 10, FIG. 11 being strictly applicable to the embodiment of FIG. 10, and FIGS. 12 and 13 showing further modifications.

Figure 1:
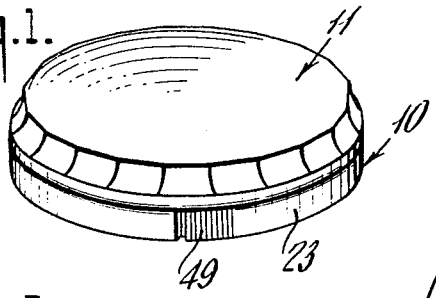
FIG. 1 is a perspective view of a closed and secured child-resistant container of the invention.
Figure 2:
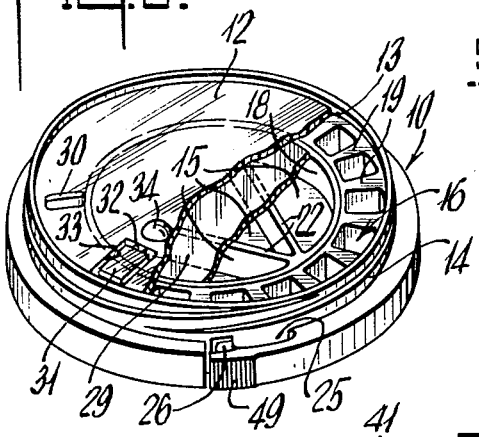
FIG. 2 is a view similar to FIG. 1, with the closure cap removed, and with a portion broken-away to reveal internal construction.

Referring initially to FIGS. 1 and 2, the invention is shown in application to a pill-dispensing container comprising but three parts, each of which may be a simple piece, injection-molded of suitable plastic, such as polypropylene, or high-density polyethylene. When closed (FIG. 1), only two of these pieces are visible, a base member 10 and a closure-cap member 11; when cap member 11 is removed (FIG. 2), the third of dispensing-lid member 12 is visible, in its assembled relation to base member 10. If considered without the selection feature afforded by the third or dispensing-lid member 12, the container is seen as comprising essentially the two pieces 10-11.

Figure 3:
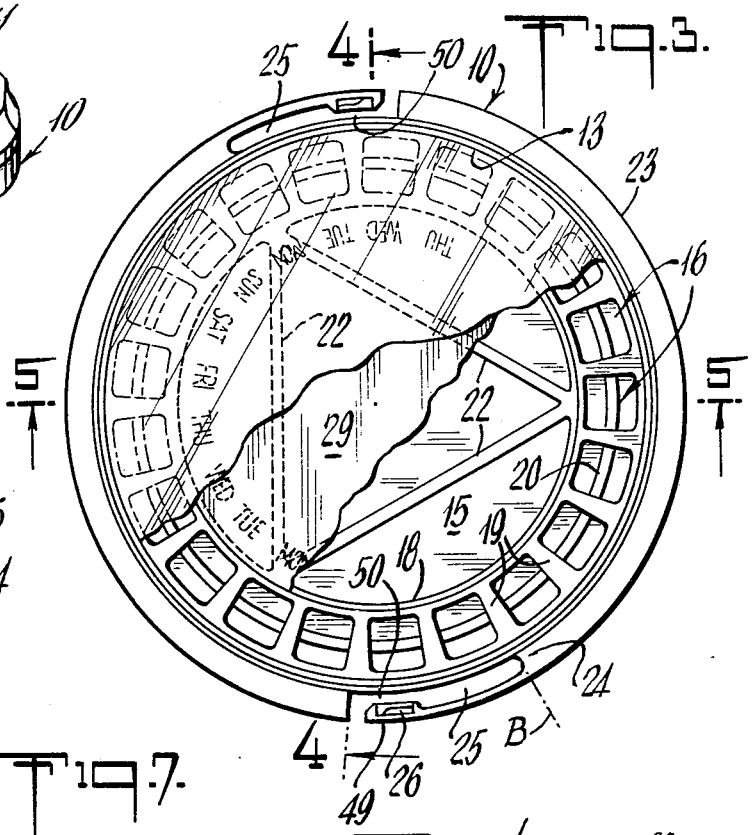
FIG. 3 is a plan view of the parts of FIG. 2.
Figure 4:
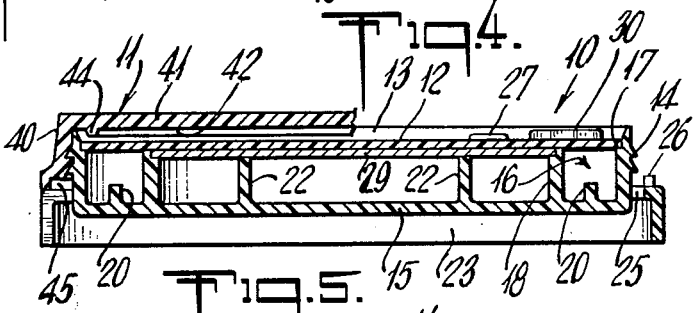
FIGS. 4 and 5 are sectional views, respectively taken at 4—4 and 5—5 in FIG. 3.
Figure 5:
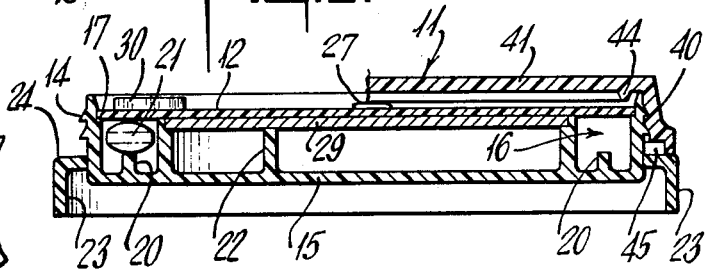

Referring additionally to FIGS. 3 to 5, base member 10 is seen to comprise an upstanding body wall 13, externally formed with threads 14 for coaction with threads of cap member 11. Body wall 13 has a bottom closure wall 15 which is internally contoured to define a plurality of angularly spaced pill compartments 16. As shown, the number of compartments is twenty-one, at equal angular spacing within an outer annulus defined between a circumferentially continuous shoulder 17 or body wall 13 and an inner annular wall 18, with angularly spaced radial walls 19 integrally connecting walls 13–18. Walls 18-19 terminate at their upper ends at the radial plane of shoulder 17, thus establishing a single seating plane for the lid member 12, which is essentially a flat disc. A central rib 20 rises centrally from the base of each compartment 16, appropriate to the dimensions of the pill size to be accommodated by each compartment, as suggested by the phantom outline of a pill 21 in FIG. 5. A triangle of upstanding reinforcing ribs 22 stabilizes wall 18 and its associated array of compartments 16, in relation to the bottom wall 15; preferably, ribs 22 extend upwardly to an elevation just short of the radial plane of shoulder 17, to accommodate press-fitted assembly of a calender disc 29, as shown.

Base member 10 is further characterized by an outer circumferential skirt 23 connected to body wall 13 at radial offsets 24 and axially beneath threads 14; skirt 23 extends downwardly from the offsets 24 and is the means of support of the entire structure, as when set upon a table top. At one or more angular locations, an arcuate slot 25 in the offset portion 24 of the skirt establishes between angularly spaced limits A-B a locally compliant and radially inwardly yieldable region of skirt 23, such region being provided with an upstanding ratchet-tooth formation 26 for coaction with cap member 11, as will later be more fully described.

Detent ribs 27 are formed at angularly spaced locations in body wall 13. These ribs extend radially inward and have ramp-sloped upper surfaces for easy-action interference with the outer edge of lid member 12 upon its assembly to shoulder 17. The lower wall of each rib 27 is preferably sharply defined in a single radial plane for snapped positive axial retention of an inserted lid member 12.

Figure 6:
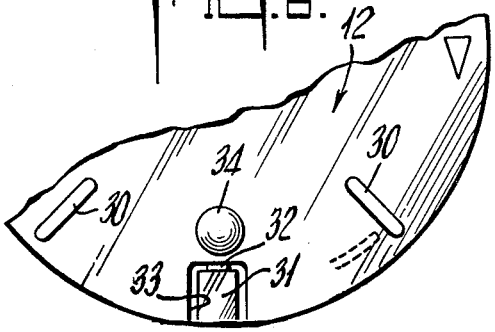
FIG. 6 is a fragmentary plan view of a part of FIG. 3.

In the additional context of FIG. 6, the lid member 12 will be seen as an essentially flat circular disc with plural spaced radially extending ribs 30, for finger engagement, to facilitate selective angular indexing advances of disc 12 within body wall 13; for a purpose which will later be more clear, the radial extent of ribs 30 preferably spans from shoulder 17 to wall 18. Disc 12 is provided with pill-dispensing means in the form of a tab 31 having locally reduced and therefore weakened integral connection 32 to the remainder of lid member 12. By lifting tab 31, access is had through an opening 33 direct to one of the compartments 16, and if the connection 32 is frangible, then tab 31 may be discarded, once it is broken off, thus signifying at once that the container contents are no longer in their original factory-packed condition. For the user's convenience in visually recalling the date of use, a magnifying lens 34 is adjacent the tab location in register with the successive-day index markings on the calendar disc 29.

The underside of disc 12 is also characterized by plural rib formations 35, but these provide an angle-locating or index-locating function and assure but a single direction of indexability, the same being suggested to the user, as by a raised arrow formation 36 in the upper surface of disc 12. Preferably, ribs 35 are of angular extent to locate within any given compartment 16, being limited by the opposed radial walls 19 of the compartment. Generally, each rib 35 is ramp-sloped, rising from a reduced end 35' to a steep-walled end 35''. The nature of the reduced and 35' is to provide relatively small resistance to indexing rotation of disc 12 in the clockwise direction indicated by arrow 36, but rotation in the counter-clockwise direction is opposed by the steep-walled flat abrupt end 35'' of each rib 35, in its abutment with the nearby radial wall 19 of the associated compartment 16. Thus, once a pill 21 has been dispensed via opening 33 for a given indexed position of disc 12, disc 12 will be retained by means 35 in the same indexed position. For access to the next pill 21, disc 12 must be rotated clockwise, and a one-compartment index for such access is signalled by a snap, as the ends 35'' clear the radial walls 19 over which they have just been resiliently cammed.

Figure 7:
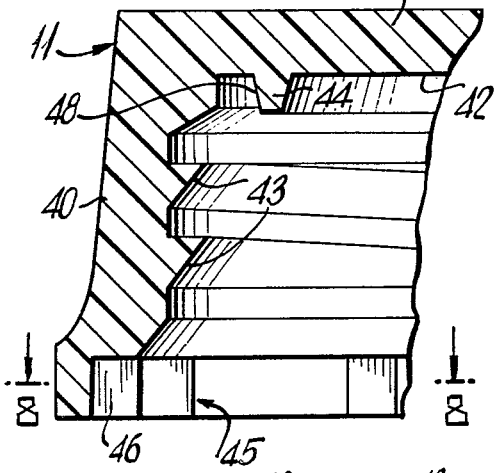
FIG. 7 is an enlarged fragmentary sectional view of part of the closure cap of FIG. 1, the section being taken in a radially extending plane which includes the axis of the cap.
Figure 8:
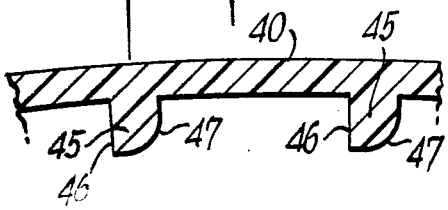
FIG. 8 is another enlarged fragmentary sectional view, taken at the plane 8—8 of FIG. 7.

Referring additionally to FIGS. 7 and 8, cap member 11 is seen to comprise a skirt wall 40 which is closed at one end by a wall 41 which may have a flat interior wall surface 42. Threads 43 in the bore of skirt 40 are for engagement with container-body threads 14, and a circumferentially continuous rib 44 projects downwardly from the closed wall 41 for frictional engagement with the upper surface of disc 12 (and radially outside ribs 30) when the closure cap is in its secured, container-sealing position, thus assuring full closure of all compartments 16 except for the compartment to which opening 33 has been indexed. The lower open end of skirt 40 is shown outwardly flared beneath threads 43 to enable definition of the plural radially inwardly facing ratchet teeth 45 which extend in continuous succession around the inner lower edge of skirt 40. As seen in FIG. 8, each of these teeth 45 has a flat radially inward wall 46 for one-way-engaging antirotational contact with the base ratchet tooth or teeth 26, in the thread-off direction of engaging threads 14–43; each tooth 45 also has a rounded opposite wall 47, for ratchet-escaping action at 26 in the thread-on direction of engaging threads 14–43.

It has been explained above that the ratchet-tooth formation 26 is at a local radially compliant deformable locale of the base-member skirt 23, adjacent an arcuate slot 25. That being the case, placement of cap member 11 over wall 13 and thread-on advance of the engagement 14–43 draws members 10-11 together to the point of initial and then increasingly positive, escaping ratchet engagement at 26–45. In final approach to the fully closed position, the upper inside edge of wall 13 develops circumferential sealing contact with the adjacent tapered wall 48 of rib 44, and rib 44 clamps down upon disc 12 (over shoulder 17) while the flat cap surface 42 engages radial ribs 30 to assure additional clamping of disc 12 to the inner annular wall 18.

In the form shown in FIGS. 1 to 4, the compliantly yieldable supporting region for tooth 26 is a circumferentially arcuate cantilevered arm 49, with tooth 26 supported at the free or cantilevered end, arm 49 being defined by an outwardly open passage to one limit (A) of the arcuate slot 25. Tooth 26 will be understood to have a flat locking face for anti-rotational abutment with the corresponding face 46 of each cap tooth 45. And to release the locked engagement, the radial clearance 50 with which the free end of arm 49 may be radially inwardly depressed will be understood to provide for disengagement of the ratchet-locking tooth faces, whereupon the cap member 11 may be unthreaded from base member 10.

Figure 9:
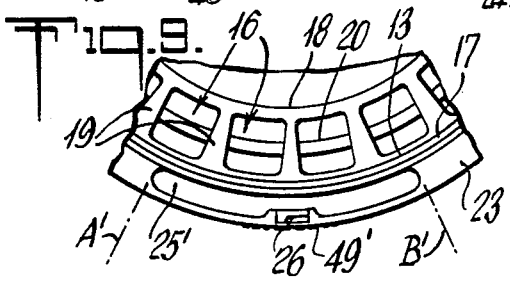
FIG. 9 is a fragmentary plan view similar to FIG. 3, but to show a modification.

In the form shown in FIG. 9, the arcuate slot 25' again extends between angular limits A'–B', but the skirt 23 remains circumferentially continuous, while the ratchet tooth 26 is formed centrally of the compliant bridge portion 49' of skirt 23. Action is otherwise as described for the embodiment of FIGS. 1 to 4.

Preferably, security is enhanced by providing base-member ratchet action at plural spaced locations. Thus, in FIGS. 1 to 4, slots 25, arms 49 and teeth 26 are provided in duplicate at diametrically opposed locations, and a similar preferred arrangement of duplicate slots 25', bridges 49' and teeth 26 will be understood for the FIG. 9 embodiment.

FIGS. 10 and 11 illustrate application of the invention to a container 50 which is a product of blow-molding with a suitable density plastic material, as of polyethylene or polypropylene. The container 50 is shown as a bottle with an elongate body which is closed except for a single opening at a reduced neck 51 at one end; the parting line between mold-halves used in blow-molding is indicated at 50'. Threads 52 on neck 51 removably accommodate internal threads in a closure cap 53, similar to those described at 43 in connection with FIG. 7. Also as in FIG. 7, the closure cap 53 includes an outward flare to an enlarged generally cylindrical skirt portion 54 at its lower (open) end, the bore of skirt portion 54 being characterized by generally radially directed ratchet teeth, axially beneath the threaded region of the bore of cap 53, as will be understood.

In accordance with a feature of the invention, a radial-flange region 55 of bottle 50 is integrally formed at the base of neck 51 and in such relation beneath threads 52 that for the fully secured or threaded-on condition of cap 53, the skirt 54 is in close axial adjacency to, if not in light axial abutment with, flange region 55. In other words, it is preferred that in the fully closed condition of the container, reliance be placed upon cap engagement with the upper rim of neck 51 to establish cap-sealing of the container contents. And one or more ratchet-equipped compliant regions 56 are integrally formed with the flange region 55. As shown in FIGS. 10 and 11, each of two diametrically opposed compliant regions 56 is established as a circumferentially arcuate tab, joined to the otherwise circumferentially continuous periphery of flange 55, such juncture being substantially at the plane of the parting line 50'; preferably, the external contour of flange 55 is such as to enable tabs 56 to conform to the essentially same continuous circle, the body of flange region 55 being locally radially inwardly offset from such circle, as at 57, to establish radial clearance at 58 for transient radially inward resilient deflection of tabs 56, the same being suggested as a finger-squeeze force at opposed heavy arrows 59 in FIG. 11. The ratchet tooth 60 with which each tab 56 is equipped may be as described at 26 for coaction with the ratchet-tooth inner contour of the cap skirt 54, it being understood that radial clearance at 58 is at least sufficient to disengage teeth 60 in the circumstance of sufficient squeeze force 59.

In the arrangement of FIG. 12, all parts are generally as described for FIGS. 10 and 11, except that the direction of arcuate projection of the compliant regions 56' is the opposite of that shown in FIGS. 10 and 11. The point of the difference in direction is that, under the assumption that threads 52 are desirably in a particular direction, such as right-handed thread advance, the ratchet-locked condition may be retained using compressional (FIG. 12) or tension (FIG. 11) support in the ratchet-equipped tab.

The arrangement of FIG. 13 will be recognized for its correspondence with the embodiment of FIG. 9, in application to the neck 61 of a blow-molded container. In FIG. 13, the locally compliant region for support of ratchet tooth 62 support is a bridge 63 which preferably conforms to the continuous circular contour of flange region 55'' of neck 61. Each bridge 63 is shown to be of limited arcuate extent, commencing at one end substantially at the plane of the parting line 50' and being radially offset from the otherwise circumferentially continuous body of flange 55'', the offset being provided by an arcuate slot 64. Slot 64 will be understood to have been formed by suitable mold elements with respect to which the molded product is axially removable.

In all the blow-molded embodiments of FIGS. 10 to 13, operation of the completed article is as previously described. The ratchet engagement is established in the course of threaded advance of the cap-to-neck engagement. Ratcheting action is one-way, escaping in the thread-on direction and locking against thread-off rotation. To release the ratchet lock, local radially inward squeeze force 59 must be maintained while unthreading proceeds sufficiently to axially clear the ratchet-engageable parts.

The structures of the described embodiments of the invention will be seen to have achieved all stated objects. Not only is the locking action positive and foolproof, for the entire useful period of a factory-filled container, but the mechanism is sufficiently rugged as to lend itself, in the case of FIGS. 1 to 9, to repeated reloading and reuse as a dispensing container. At no time can the compliantly suspended ratchet teeth be damaged due to excessive radially inward depression, because the clearance available for such depression is at all times limited by the mere traversal of the effective radial width of the slot 25 (25') or clearance 58.

While the invention has been described in detail for the preferred forms shown, it will be understood that modifications may be made without departure from the invention. For example, the multiple-ratchet action need not be cophasal as in the presently disclosed embodiments, but rather may involve dual ratcheting in phase-interlace, as described for a different child-safety closure mechanism in Landen U.S. Pat. No. 3,884,379, wherein the ratchet-snap action for each of two ratchets is caused to alternate between the two ratchets, thus achieving twice as many possible ratchet-locked angular positions as there are ratchet teeth in the skirt of the cap member.

What is claimed is:

1. A container with safety closure, comprising: a container-body member having a dispensing opening at one end and including an upstanding circular body wall with external thread formations at a threaded region which is axially above an unthreaded region, and a closure-cap member including a skirt with internal threads for selective engagement with said body-wall threads; said cap-member skirt having plural radially-inwardly directed ratchet teeth axially beneath the threads thereof, said ratchet teeth being at a location of axial overlap with said unthreaded region of said body wall when said cap is thread-engaged to said body member, said container-body member comprising an inner upwardly open body portion having said threaded region, said body member further integrally including a downwardly extending body-member skirt connected at its upper axial end to said body portion at a location beneath said threaded region, said body-member skirt otherwise extending circumferentially of and in radial clearance with said body portion, said body-member skirt having at one angular location and in the axial region of said cap-member skirt a radially inwardly compliant portion whereby said inwardly compliant portion may be transiently and resiliently inwardly displaced, said radially inwardly compliant portion being essentially only radially inwardly displaceable, and a ratchet-locking tooth formation integrally formed with said compliant portion, said tooth formation being inwardly displaced upon such inward displacement of said compliant portion and having (a) ratchet-escaping engagement with cap-member teeth in the thread-on direction of cap-member threaded engagement with said base member and (b) ratchet-locking engagement with said cap-member teeth in the thread-off direction of such threaded engagement.

2. A container with safety closure, comprising: a blow-molded plastic container-body member having a dispensing opening at one end and including an upstanding circular body wall with external thread formations at a threaded region which is axially above an unthreaded region, and a closure-cap member including a skirt with internal threads for selective engagement with said body-wall threads; said cap-member skirt having plural radially-inwardly directed ratchet teeth axially beneath the threads thereof, said ratchet teeth being at a location of axial overlap with said unthreaded region of said body wall when said cap is thread-engaged to said body member, said body member having at one angular location and in the axial region of said cap-member skirt a radially inwardly compliant portion whereby said inwardly compliant portion may be transiently and resiliently inwardly displaced, said radially inwardly compliant portion being essentially only radially inwardly displaceable, and a ratchet-locking tooth formation integrally formed with said compliant portion, said tooth formation being inwardly displaced upon such inward displacement of said compliant portion and having (a) ratchet-escaping engagement with cap-member teeth in the thread-on direction of cap-member threaded engagement with said base member and (b) ratchet-locking engagement with said cap-member teeth in the thread-off direction of such threaded engagement; said blow-molded plastic container-body member being characterized by a parting-line plane of symmetry through the central axis of said container-body member, said compliant portion being contained in essentially that part of said container-body member which is on one side of the parting-line plane and local to one to the exclusion of the other of the circumferential intercepts of said container-body member with the parting-line plane.

3. The container of claim 2, in which said compliant portion comprises a tab having integral substantially tangential connection to said container-body member substantially at the parting-line plane.

4. The container of claim 3, in which said tab is one of two at diametrically opposite locations, the respective tabs extending to opposite sides of the parting-line plane.

5. The container of claim 2, in which said compliant portion comprises an arcuate bridge having integral connection to said container-body member at both its circumferential ends, one of said ends being substantially at the parting-line plane.

* * * * *